US008980519B2

(12) United States Patent
Morales-Tirado et al.

(10) Patent No.: US 8,980,519 B2
(45) Date of Patent: Mar. 17, 2015

(54) TONER COMPOSITION

(71) Applicant: Xerox Corporation, Norwalk, CT (US)

(72) Inventors: Juan A. Morales-Tirado, Henrietta, NY (US); Samir Kumar, Pittsford, NY (US); Michael F. Zona, Holley, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/900,776

(22) Filed: May 23, 2013

(65) Prior Publication Data

US 2014/0349229 A1 Nov. 27, 2014

(51) Int. Cl.
*G03G 9/00* (2006.01)
*G03G 9/08* (2006.01)

(52) U.S. Cl.
CPC ..... *G03G 9/0825* (2013.01)
USPC ..... 430/123.51

(58) Field of Classification Search
CPC ..... G03G 9/08; G03G 9/0827; G03G 9/0832; G03G 9/09708
USPC ..... 430/108.6, 123.51
See application file for complete search history.

(56) References Cited

U.S. PATENT DOCUMENTS

| | | | | |
|---|---|---|---|---|
| 6,896,937 | B2 | 5/2005 | Woudenberg et al. | |
| 7,480,475 | B2 * | 1/2009 | Miyoshi et al. | 399/252 |
| 8,449,095 | B2 | 5/2013 | Breton et al. | |
| 2007/0231727 | A1 * | 10/2007 | Baird et al. | 430/108.4 |
| 2011/0152397 | A1 | 6/2011 | Breton et al. | |

* cited by examiner

*Primary Examiner* — Thorl Chea
(74) *Attorney, Agent, or Firm* — Shimokaji & Associates, P.C.

(57) ABSTRACT

A toner composition includes a resin, optionally a wax, a colorant, and an acicular surface additive. The toner composition is suitable for use in a single component development system and which composition possesses excellent charging, stability, and flow characteristics.

4 Claims, 4 Drawing Sheets

TONER COMPOSITION

TECHNICAL FIELD

This disclosure is generally directed to toner compositions and methods for producing such toner compositions for use in forming and developing images of good quality. More specifically, this disclosure is directed to toner compositions having stable development and robust cleaning performance, and methods for producing such toner compositions.

BACKGROUND

Numerous processes are known for the preparation of toner particles, such as, for example, conventional processes wherein a resin is melt kneaded or extruded with a pigment, micronized, and pulverized to provide the toner particles. The toner particles may also be produced by emulsion aggregation (EA) methods. Methods of preparing EA type toner particles are within the purview of those skilled in the art, and toner particles may be formed by aggregating a colorant with a latex polymer formed by emulsion polymerization.

Toner systems normally fall into two classes: two component systems, in which the developer material includes magnetic carrier granules having toner particles adhering triboelectrically thereto; and single component systems, which generally use only toner. In single component development systems, both magnetic and non-magnetic systems are known.

Placing charge on toner particles, to enable movement and development of images via electric fields, is often accomplished with triboelectricity. Triboelectric charging may occur either by mixing the toner with larger carrier beads in a two component development system or by rubbing the toner between a blade and donor roll in a single component system.

With non-magnetic single component development (SCD), the toner may be supplied from a toner house to a supply roll and then to a development roll. The toner may be charged while it passes a charging/metering blade. Non-magnetic SCD toner requires high flowability and high chargeability because the time for toner to flow through the contacting nip formed between the blade and the development roll is very short. Low charge causes reduced solid area development, increased toner dusting in white areas of the page (background), and/or poor development stability over time.

Another issue with SCD systems is toner robustness. The high stress under the blade may cause the toner to stick to the blade or the development roll. This may reduce the toner charge and the toner flowability. Since non-magnetic toner is charged through a charging/metering blade, low charging and low flowability may cause print defects such as ghosting, white bands, low toner density on images, and/or background development.

Surface additives having round shape particles are commonly used during the preparation of conventional toner particles for the purpose of reducing surface forces and improving the toner's flow. Examples of common surface additives may be, for example, round shaped titanium dioxide and silica carbide.

There remains a need for a toner composition suitable for high speed printing, particularly high speed printing that may provide excellent flow, stability, charging, and improved photoreceptor cleaning in a non-magnetic single component development system.

SUMMARY

The following detailed description is of the best currently contemplated modes of carrying out exemplary embodiments herein. The description is not to be taken in a limiting sense, but is made merely for the purpose of illustrating the general principles of the exemplary embodiments herein, since the scope of the invention is best defined by the appended claims.

Various inventive features are described below that can each be used independently of one another or in combination with other features.

According to aspects illustrated herein, there is provided a toner composition having a resin, optionally a wax, a colorant, an acicular surface additive, optionally a spherical inorganic surface additive, and optionally a lubricating surface additive.

According to other aspects illustrated herein, there is provided a toner particle having an acicular surface additive in an outer layer of the toner particle.

According to further aspects illustrated herein, there is provided a toner particle having an acicular surface additive and having a circularity of from about 0.969 to about 0.998.

BRIEF DESCRIPTION OF THE FIGURES

Various embodiments of the present disclosure will be described herein below with reference to the following figures wherein.

DETAILED DESCRIPTION

The present disclosure provides a toner suitable for use, as an example, in a single component development system and which toner possesses excellent charging, stability, and flow characteristics.

Acicular surface additives may be included in embodiments herein to reduce surface forces and to tailor the toner particle flow characteristics without introducing changes to the particle shape. The surface additives may adhere to the toner particles separating the toner particles from other surfaces. This separation can reduce the adhesive and cohesive forces on the toner and can improve transfer of toner from the photoconductor to intermediate and final receivers.

An acicular surface additive, for example acicular $TiO_2$, may provide excellent stability and flow characteristics to the resulting toners. In addition, the toner compositions according to embodiments herein may reduce the incidence of blade clogging, print defects, and low toner density compared with conventionally produced toners.

In embodiments herein, the term "acicular" may refer to particles having irregular, slender, or needle shaped, rice shaped, stick shaped, butterfly shaped, or bow tie shaped.

The acicular shape of the surface additive herein may help to achieve better toner cleanability from a photoreceptor surface in a cleaning blade system. The acicular surface additive may be applied for improved relative humidity (RH) stability, tribo charging, and improved development of the image. Moreover, it is considered that the acicular surface additive may contribute to improving the charging property across a wide range of environmental temperatures and humidities of an otherwise toner particle containing only spherical shaped additives.

Figure 1:
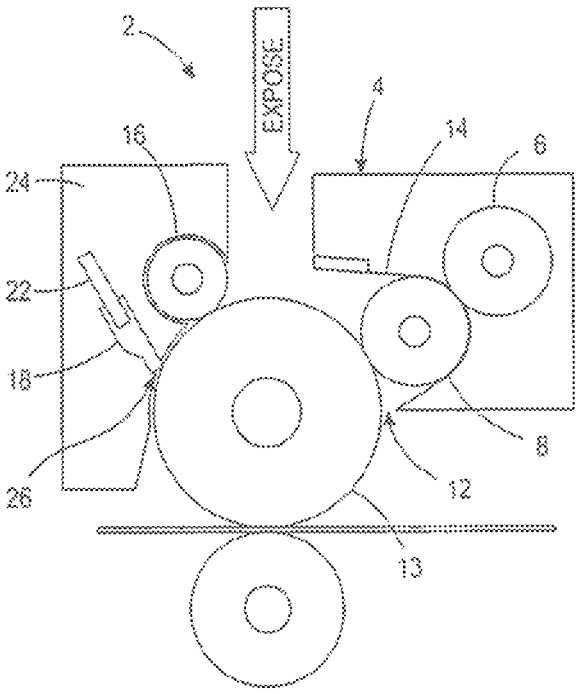
FIG. 1 illustrates the development hardware used in a non-magnetic single component development architecture.

FIG. 1 shows a printing system 2 according to an embodiment, such as a non-magnetic, single component development system. Toner (not shown) is filled into a cartridge sump 4. A paddle (not shown) or gravity is used to load the toner to a supply roller 6. The toner is then transferred to a development roll 8. As the development roll 8 rotates, the toner can be metered in the nip 12 of the charge blade 14 and development roll 8. A photoconductor drum 13 may be located in contact with the development roll 8. The development roll 8 may be connected to a voltage source 16. A cleaning blade 18 which may include urethane or silicone rubber blade mounted onto a rigid holder 22 is attached to the cartridge housing 24. The physical characteristic and dimensions of the cleaning blade 18, for example, modulus, thickness, and length, may depend on the size of the photoconductor drum 13. The forces created at the small nip 26 formed between the cleaning blade 18 and the photoconductor drum 13 desirably prevents residual toner from getting under the cleaning blade 18 and contaminating the voltage source 16. The toner should be able to charge and flow well in the nip 12 created between the charge blade 14 and the development roll 8 to enable sufficiently charged developed mass on the photoconductor drum 13 when brought into contact with the latent image.

Figure 2:
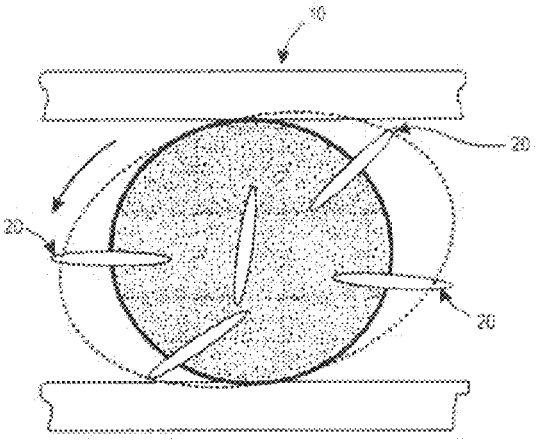
FIG. 2 illustrates a toner particle having acicular $TiO_2$ according to an exemplary embodiment as disclosed herein.

FIG. 2 shows a caricature of a toner particle 10, according to exemplary embodiments herein. This caricature depiction, however, is not intended to limit the scope of the embodiments disclosed herein and is only presented for ease of understanding. The toner particle 10 according to embodiments herein may not require changes in the mechanical design of the xerographic printing devices.

The toner particle 10 may include a resin/binder, colorant, gel, and wax.

As can be seen from FIG. 2, an acicular surface additive 20 in the toner particle, for example $TiO_2$, may be adhered to the external surfaces of the toner particles 10, rather than being incorporated into the bulk of the toner particles 10.

Using the acicular surface additive 20 may reduce the moment of inertia of otherwise conventional toner particles and hence the rolling effect of the toner particles under the contacting nip formed between a photoreceptor surface and a cleaning blade (not shown) of an SCD system. The presence of the acicular surface additive 20 in the toner particle 10 may also reduce the probability of otherwise spherical toner particles rolling on the photoreceptor surface (not shown) and/or underneath the cleaning blade (not shown) of an SCD system. In addition, the acicular surface additive 20 may increase the cleaning efficiency of the cleaning blade (not shown) against a photoreceptor surface.

Acicular Surface Additive

Acicular surface additive(s) may be used as reinforcing agents to enhance the mechanical strength properties of the toner particle. The acicular particles are attached onto the surface of the toner particles primarily by electrostatic forces and to a lesser extent by mechanical impaction. This may allow the acicular particles to be present in the outer surface of the toner particles so that the longitudinal direction of the acicular particles is parallel or oblique to the surface of the printing device, which enables the toner particles to slide on the printing blade.

In some embodiments, the acicular surface additive 20 may be, for example, acicular carbon fiber, acicular fiber glass, acicular carbon nanotubes, and acicular magnesium fiber. In an exemplary embodiment, acicular titanium dioxide (acicular $TiO_2$) may be the surface additive, though there may be more than one acicular surface additive used.

The acicular surface additive 20 may reduce the rolling tendency of otherwise conventional toner particles in an SCD system. The shape of the acicular surface additive may be, for example, needle shaped or irregular shaped. In some embodiments, the shape of the acicular surface additive may be, for example, rice shaped, stick shaped, butterfly shaped, or bow tie shaped. Because of the acicular shape, the additive may provide mechanical strength for the toner particle 10.

In some embodiments, the acicular surface additive may be from about 0.25% to about 1.0% by weight or from about 0.40 to about 0.60% by weight, or about 0.5% by weight of the toner composition.

The particles of acicular surface additive may not be very long in length, for example, from about 0.5 to about 6.0 microns, or from about 2.0 to about 4.0 microns, or from about 0.5 to 1.5 microns. But the acicular surface additive particles may have high aspect ratios (length/diameter), such as from about 5.0 to about 25.0 (l/d), or from about 8.0 to about 15.0 (l/d). Thus, the acicular surface additive may reduce the moment of inertia of the toner particles that prevents sliding/rolling under the cleaning blade (not shown) held against the photoreceptor surface.

The acicular $TiO_2$, may be, for example, acicular $TiO_2$ sold by Titan Kogyo or Sangyo Kaisha that comes in different shapes as shown in the following micrographs.

Figure 5A:
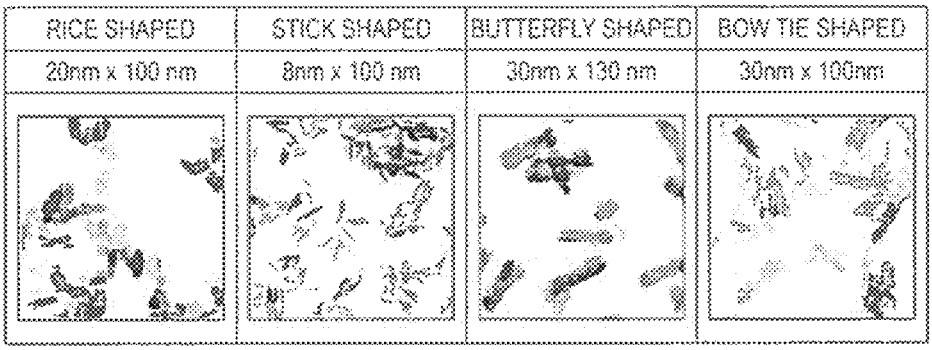
FIGS. 5A and 5B depict exemplary acicular $TiO_2$ in accordance with embodiments.

The acicular $TiO_2$, may be, for example, acicular $TiO_2$ sold by Titan Kogyo or Sangyo Kaisha that comes in different shapes as shown in FIG. 5A.

Figure 5B:
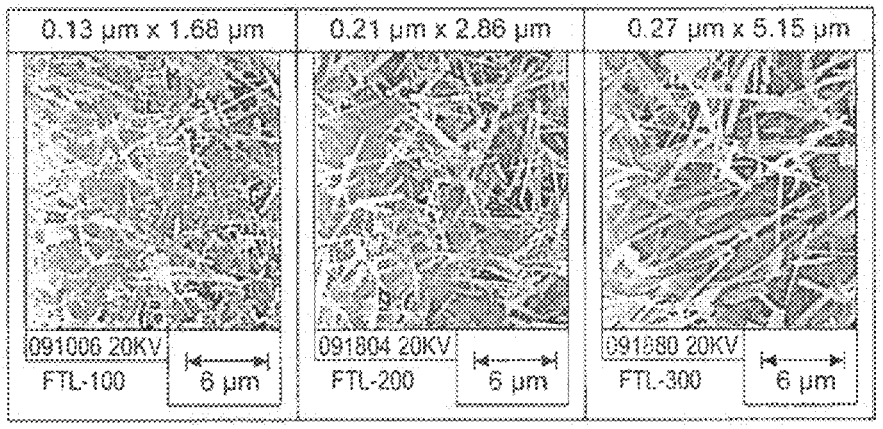

Similar materials are supplied by Sangyo Kaisha. These materials have a stick like shape, as shown in FIG. 5B, but are larger than those offered by Titan Kogyo Basic Properties Sangyo Kaisha

| | FTL-100 | FTL-200 | FTL-300 |
|---|---|---|---|
| Composition/ Crystal | $TiO_2$/Rutile | $TiO_2$/Rutile | $TiO_2$/Rutile |
| Surface Treatment | — | — | — |
| Shape/ Color | Acicular/White | Acicular/White | Acicular/White |
| Particle Length (μm) | 1.68 | 2.86 | 5.15 |
| Particle Diameter (μm) | 0.13 | 0.21 | 0.27 |
| Specific Gravity | 4.2 | 4.2 | 4.2 |
| Specific Surface area ($m^2/g$)$^{2)}$ | 10~15 | 7~10 | 5~7 |
| Oil Absorption (g/100 g) | 35~60 | 35~60 | 30~60 |
| pH | 6~8 | 6~8 | 6~8 |

Latex Resin

The toner composition may include, for example, a latex resin in combination with a pigment.

Any monomer suitable for preparing a latex for use in a toner particle may be utilized. Such latexes may be produced by conventional methods. In some embodiments the toner particle may be produced by emulsion aggregation. Suitable monomers useful in forming a latex emulsion, and thus the resulting latex particles in the latex emulsion, include, but are not limited to, styrenes, acrylates, polyesters, methacrylates, butadienes, isoprenes, acrylic acids, methacrylic acids, acrylonitriles, combinations thereof, and the like.

The resin may be prepared by any method within the purview of those skilled in the art. Illustrative examples of suitable toner resins include, for example, thermoplastic resins such as vinyl resins in general or styrene resins in particular, and polyesters. Examples of suitable thermoplastic resins include styrene methacrylate; polyolefins; styrene acrylates, such as PSB-2700 obtained from Hercules-Sanyo Inc.; styrene butadienes; crosslinked styrene polymers; epoxies; polyurethanes; vinyl resins, including homopolymers or copolymers of two or more vinyl monomers; and polymeric esterification products of a dicarboxylic acid and a dial comprising a diphenol. Other suitable vinyl monomers include styrene; p-chlorostyrene unsaturated mono-olefins such as ethylene, propylene, butylene, isobutylene, and the like; saturated mono-olefins such as vinyl acetate, vinyl propionate, and vinyl butyrate; vinyl esters such as esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile; methacrylonitrile; acrylamide; mixtures thereof; and the like. In addition, crosslinked resins, including polymers, copolymers, and homopolymers of styrene polymers, may be selected.

In some embodiments, the resin of the latex may include at least one polymer. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and combinations thereof.

The polymer may be block, random, or alternating copolymers. In embodiments, a poly(styrene-butyl acrylate) may be utilized as the latex. The glass transition temperature of this latex may be from about 35° C. to about 75° C., and in other embodiments from about 40° C. to about 70° C.

In other embodiments, the polymer utilized to form the latex may be a polyester resin. The polyesters may be amorphous, crystalline, or both. In embodiments, an unsaturated polyester resin may be, for example, unsaturated polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

Surfactants

In some embodiments, the latex resin may be prepared in an aqueous phase containing a surfactant or co-surfactant. Surfactants which may be utilized with the resin to form a latex dispersion can be ionic or nonionic surfactants in an amount of from about 0.01 to about 15 weight percent of the solids, and in embodiments of from about 0.1 to about 10 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, combinations thereof, and the like. In embodiments commercially available surfactants from Rhone-Poulenc such as IGEPAL CA-210™, IGEPAL CA-520™, IGEPAL CA-720™, IGEPAL CO890™, IGEPAL CO720™, IGEPAL CO290™, IGEPAL CA-210™, ANTAROX 890™ and ANTAROX 897™ can be utilized. The choice of particular surfactants or combinations thereof, as well as the amounts of each to be used, are within the purview of those skilled in the art.

Initiators

In various embodiments, initiators may be added for formation of the latex. Examples of suitable initiators include water soluble initiators, such as ammonium persulfate, sodium persulfate and potassium persulfate, and organic soluble initiators including organic peroxides and azo compounds including Vazo peroxides, such as VAZO 64™ 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine)dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine]tetrahydrochloride, 2,2'-azobis[2-methyl-N(phenylmethyl)propionamidine]dihydrochloride, 2,2'-azobis[2-methyl-N-2-propenylpropionamidine]dihydrochloride, 2,2'-azobis[N-(2-hydroxy-ethyl)2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane] dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis {2-[1-(2-hydroxyethyl)-2-imidazolin-2-yl]propane}dihydrochloride, combinations thereof, and the like.

Initiators can be added in suitable amounts, such as from about 0.1 to about 8 weight percent, and in some embodiments of from about 0.2 to about 5 weight percent of the monomers.

Chain Transfer Agents

In various embodiments, chain transfer agents may also be utilized in forming the latex. Suitable chain transfer agents include dodecane thiol, octane thiol, carbon tetrabromide, combinations thereof, and the like, in amounts from about 0.1 to about 10 percent and, in other embodiments, from about 0.2 to about 5 percent by weight of monomers, to control the molecular weight properties of the polymer when emulsion polymerization is conducted in accordance with the present disclosure.

Stabilizers

In exemplary embodiments, it may be advantageous to include a stabilizer when forming the latex particles. Suitable stabilizers may include monomers having carboxylic acid functionality.

In embodiments, the stabilizer having carboxylic acid functionality may also contain a small amount of metallic ions, such as sodium, potassium and/or calcium, to achieve better emulsion polymerization results. The metallic ions may be present in an amount from about 0.001 to about 10 percent by weight of the stabilizer having carboxylic acid functionality, and in certain embodiments from about 0.5 to about 5 percent by weight of the stabilizer having carboxylic acid functionality. Where present, the stabilizer may be added in amounts from about 0.01 to about 5 percent by weight of the toner, and in other embodiments from about 0.05 to about 2 percent by weight of the toner.

Additional stabilizers that may be utilized in the toner composition processes include bases such as metal hydroxides, including sodium hydroxide, potassium hydroxide, ammonium hydroxide, and optionally combinations thereof. Also useful as a stabilizer is sodium carbonate, sodium bicarbonate, calcium carbonate, potassium carbonate, ammonium carbonate, combinations thereof, and the like. In embodiments, a stabilizer may include a composition containing sodium silicate dissolved in sodium hydroxide.

pH Adjustment Agent

In some embodiments, a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Colorant

Colorant useful in forming toners particles in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, and/or combinations thereof.

In one embodiment, the colorant may be a pigment. The pigment may be, for example, carbon black, phthalocyanines, quinacridones or RHODAMINE B™ type, red, green, orange, brown, violet, yellow, fluorescent colorants, and the like. Exemplary colorants may include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigment magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido) phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonamide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, combinations of any of the foregoing, and the like. The dyes may be utilized in various suitable amounts, for example, from about 0.5 to about 20 percent by weight of the toner, and in some embodiments, from about 5 to about 18 weight percent of the toner.

In various embodiments, colorant examples may include Pigment Blue 15:3 having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like. In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant.

The colorant may be present in the toner particle of the disclosure in an amount of from about 1 to about 25 percent by weight of toner, and in other embodiments in an amount of from about 2 to about 15 percent by weight of the toner. The resulting latex, optionally in a dispersion, and colorant dispersion may be stirred and heated to a temperature of from about 35° C. to about 70° C., and in various embodiments of from about 40° C. to about 65° C., resulting in toner aggregates of from about 2 microns to about 10 microns in volume average diameter, and in other embodiments of from about 5 microns to about 8 microns in volume average diameter.

Coagulants

In embodiments, a coagulant may be added during or prior to aggregating the latex and the aqueous colorant dispersion. The coagulant may be added over a period of time from about 1 minute to about 60 minutes, and in some embodiments from about 1.25 minutes to about 20 minutes, depending on the processing conditions. Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to contain the formula $Al_{13}O_4(OH)_{24}(H_2O)_{12}$ with about 7 positive electrical charges per unit.

In exemplary embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.01 to about 5 percent by weight of the toner, and in some embodiments from about 0.1 to about 3 percent by weight of the toner.

Wax

Wax dispersions may also be added during formation of a latex or toner particle in an emulsion aggregation synthesis. Suitable waxes include, for example, submicron wax particles in the size range of from about 50 to about 1000 nanometers, and in some embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in other embodiments of from about 0.5 to about 15 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

Examples of polypropylene and polyethylene waxes may include those commercially available from Allied Chemical and Baker Petrolite; wax emulsions available from Michelman Inc. and the Daniels Products Company; EPOLENE N-15 commercially available from Eastman Chemical Products, Inc.; VISCOL 550-P, a low weight average molecular weight polypropylene available from Sanyo Kasel K. K., and similar materials. In embodiments, commercially available polyethylene waxes possess a molecular weight (Mw) of from about 100 to about 5000, and in other embodiments of from about 250 to about 2500, while the commercially available polypropylene waxes have a molecular weight of from about 200 to about 10,000, and in some embodiments of from about 400 to about 5000.

In embodiments, the waxes may be functionalized. Examples of groups added to functionalize waxes include amines, amides, imides, esters, quaternary amines, and/or carboxylic acids. In some embodiments, the functionalized waxes may be acrylic polymer emulsions, for example, JONCRYL 74, 89, 130, 537, and 538, all available from Johnson Diversey, Inc.; or chlorinated polypropylenes and polyethylenes commercially available from Allied Chemical, Baker Petrolite Corporation and Johnson Diversey, Inc. The wax may be present in an amount of from about 0.1 to about 30 percent by weight, and in some embodiments from about 2 to about 20 percent by weight of the toner.

Aggregating Agents

Any aggregating agent capable of causing complexation might be used in forming toners particles of the present disclosure. Both alkali earth metal or transition metal salts can be utilized as aggregating agents. In embodiments, alkali (II) salts can be selected to aggregate latex resin colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions which may be utilized as an aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, combinations thereof, and the like.

In various embodiments, the toner particles may also contain other optional additives, as desired or required. For example, the toner particle may include additional positive or negative charge control agents, for example, in an amount of from about 0.1 to about 10 percent by weight of the toner particle, and in some embodiments from about 1 to about 3 percent by weight of the toner particle. Examples of suitable charge control agents include quaternary ammonium compounds inclusive of alkyl pyridinium halides; bisulfates; alkyl pyridinium compounds, organic sulfate and sulfonate compositions; cetyl pyridinium tetrafluoroborates; distearyl dimethyl ammonium methyl sulfate; aluminum salts including such as BONTRON® E-84 or BONTRON® E-88 (Hodogaya Chemical); combinations thereof, and the like. BONTRON® E-84 is a zinc complex of 3,5-di-tert-butylsalicylic acid in powder form. BONTRON® E-88 is a mixture of hydroxyaluminum-bis[2-hydroxy-3,5-di-tert-butylbenzoate] and 3,5-di-tert-butylsalicylic acid.

There can also be blended with the toner particles external additive particles including flow aid additives, which additives may be present on the surface of the toner particles. Examples of these additives include metal oxides such as titanium oxide, titanium dioxide, silicon oxide, silicon dioxide, tin oxide, mixtures thereof, and the like; colloidal and amorphous silicas, such as AEROSIL®, metal salts and metal salts of fatty acids inclusive of zinc stearate, strontium stearate, calcium stearate, aluminum oxides, cerium oxides, and mixtures thereof. Each of these external additives may be present in an amount of from about 0.1 percent by weight to about 5 percent by weight of the toner, and in some embodiments of from about 0.25 percent by weight to about 3 percent by weight of the toner particle.

EXAMPLE

The following Example illustrates one exemplary embodiment of the present disclosure. This Example is intended to be illustrative only to show one of several methods of preparing the toner particle and is not intended to limit the scope of the present disclosure. Also, parts and percentages are by weight unless otherwise indicated.

Toner Particle Preparation

EA toner particles were prepared in a 20 gallon reactor. The reactor was equipped with two stainless steel impellers mounted on a vertical shaft. a condenser, a nitrogen inlet, a thermometer, a I2R thermocouple adapter, and an heating and cooling jacket. The reactor was charged with 29.7 kg of de-ionized water, 15.7 kg of a styrene-butylacrylate resin in a latex emulsion having a solids content of about 41.5%, 0.71 kg of a cyan pigment dispersion having a solids content of about 17%, and about 3.47 kg of a carbon black pigment dispersion having a solids content of about 17%.

The contents in the reactor were mixed together before adding 2.96 kg of a Paraffin wax dispersion having a solids content of around 31% and 1.76 kg of an acid solution with an agglomerating agent such as polyaluminum chloride. The wax dispersion was added through a homogenization loop to assure large agglomerate was broken down into small size particles. After the wax dispersion and agglomerating agent solution were added to the reactor, all the components in the reactor were homogenized for six minutes or until the size of the particles in dispersion were within a predetermine value.

After the ingredients in the reactor were homogenized, the temperature of the mixture was raised to around 56° C., until the particles aggregate reached the target size. At this point, the pre-shell aggregate or core formation had been completed. Once the particles reached the target size, an additional 7.59 kg of a styrene-butylacrylate resin in a latex emulsion were added into the reactor. The latex was mixed into the reactor until the particles had reached their final target size and sufficient time had been allowed to incorporate all of the additional latex emulsion into the core particles. Once the target size was reached, the shell formation step had been completed.

Once the final size was achieved, the growth of the particles was stopped by the addition of 1.395 g of sodium hydroxide until the slurry pH reached a value from 4.5 to 4.9. Once the pH was confirmed, the batch target temperature was raised to a 96° C. When the slurry reached a temperature of 90° C., its pH was adjusted by the addition of 190 g nitric acid until the slurry pH reached a value of 3.8 to 4.2

Once the batch reached 96° C., the temperature of the slurry was maintained constant and the circularity of the particles was monitored over time. Once the circularity reached the target value of from about 0.980 to about 0.990, or from about 0.985 to about 0.990, or about 0.988, the temperature of the slurry was lowered to 53° C. at a rate of 0.6° C./min. When the temperature of the slurry reached 57° C., the pH was adjusted by the addition of 774 g of sodium hydroxide until the slurry pH reached a value of 7.5-7.9.

Once the slurry with particles having the predetermine size and circularity was made, the particles underwent a series of steps referred to as downstream operations. These operations include sieving of the slurry to remove particles having a size larger than the predetermine size of the particles required that may have been formed due to the high temperature in the reactor, washing the particle to remove surfactants or other ionic species that impart undesired charging properties, and removal of excess moisture by drying the particles.

Toner Composition Preparation

The EA particles were combined with surface additives in a 10 L vertical high intensity mixer such as those supplied by Henschel. The mixer was charged with 3.3 lbs. of EA particles followed by surface treated fumed silica at a content of about 1.4%. Once the EA particles and surface treated fumes silica were blended, the acicular TiO2 was added. The ingredients in the mixer were mixed together for about 13.3 minutes. After this first mixing cycle, a metal stearate additive was added at a content of 0.14%. All the ingredients in the mixer were mixed together for 3 minutes.

Table I shows the components of each exemplary toner composition, including the amount of each component, made according to the above Example.

TABLE I

| | Toner 1 | Toner 2 | Toner 3 | Toner 4 | Toner 5 |
|---|---|---|---|---|---|
| EA Particles (lbs.) | 3.3 | 3.3 | 3.3 | 3.3 | 3.3 |
| % Surface Treated Silica | 1.4 | 1.4 | 1.4 | 1.4 | 1.4 |

TABLE I-continued

| | Toner 1 | Toner 2 | Toner 3 | Toner 4 | Toner 5 |
|---|---|---|---|---|---|
| % Metal Stearate | 0.14 | 0.14 | 0.14 | 0.14 | 0.14 |
| % Acicular $TiO_2$ | 0 | 0.25 | 0.50 | 0.50 | 1.0 |

Toner 3 and Toner 4 have the exact same composition. The difference is that in Toner 4 the acicular TiO2 was added with the metal stearate during the second mixing step. For the other toners having acicular TiO2 the additive was added during the first step with the surface treated silica.

Figure 3:
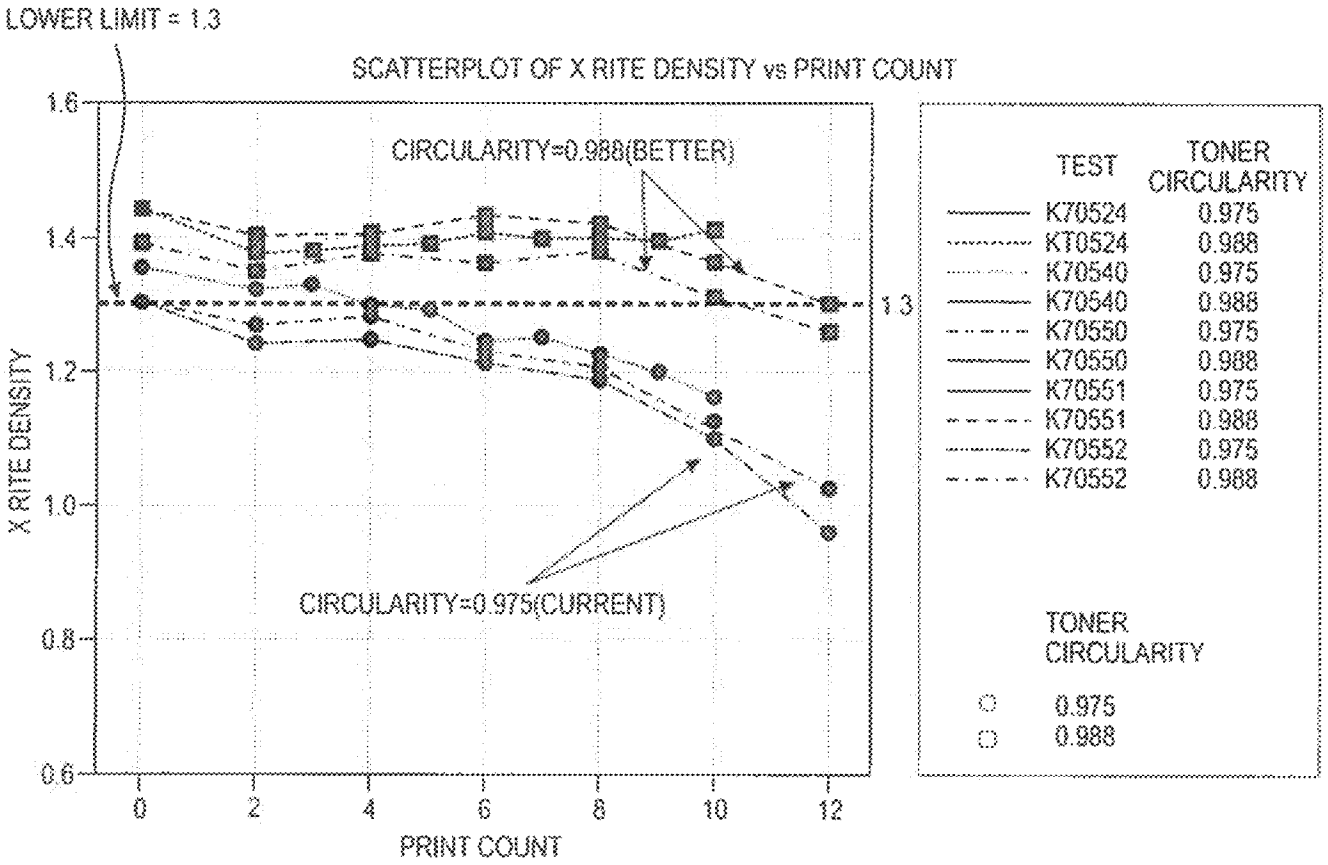
FIG. 3 is a graph showing the density changes versus the print count for a conventional toner composition and a toner composition according to embodiments herein.

FIG. 3 is a graph showing density change versus print count for a conventional toner composition and a toner composition including acicular $TiO_2$ according to embodiments herein. The graph shows decreasing density of the toner composition with increasing print count when using a conventional toner composition having toner particles with a circularity of 0.975. However, the toner composition according to embodiments herein, having toner particles with a circularity of 0.988 is more stable over time. In addition, FIG. 3 shows that the toner particles of the embodiments herein have a density of at least 1.3 densitometer units.

Figure 4:
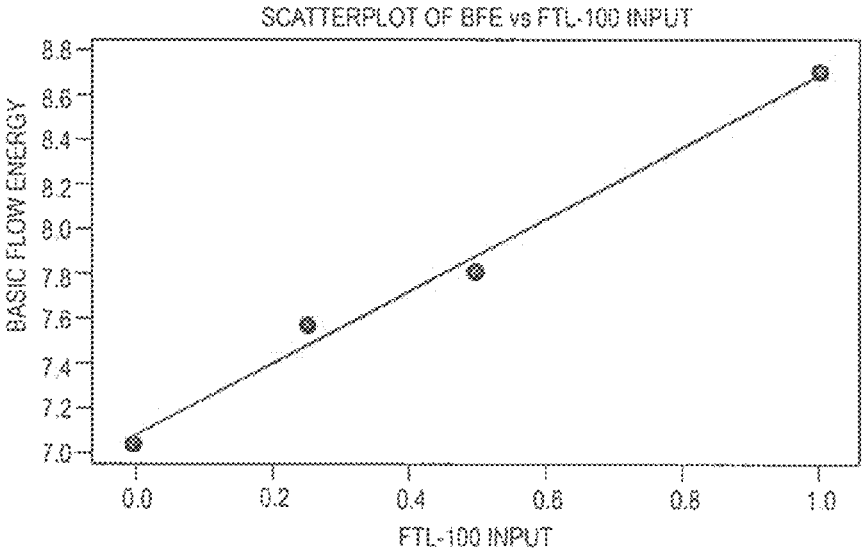
FIG. 4 is a graph showing flow energy versus amount of acicular $TiO_2$ in a toner composition according to embodiments herein.

FIG. 4 illustrates a graph showing amount of energy required for the toner to flow versus amount of acicular $TiO_2$ in a toner composition according to embodiments herein. As can be seen from the graph, as the amount of acicular $TiO_2$ increases, the amount of energy required for the toner to flow also increases. The increased energy required to initiate bulk flow of the toner particles with increased amount of acicular titania is an indication of reduced flowability and increased particle-to-particle interlocking. This means that more force is required to break a consolidated group of particles and also get the particles to roll, which is providing the cleaning improvement.

It will be appreciated that variations of the above-disclosed and other features and functions, or alternatives thereof, may be desirably combined into many other different systems or applications. Also that various, presently unforeseen or unanticipated, alternatives, modifications, variations or improvements therein may be subsequently made by those skilled in the art which are also intended to be encompassed by the following claims.

What is claimed is:

1. A toner particle comprising an acicular surface additive in an outer layer of the toner particle, wherein the acicular surface additive is selected from the group consisting of acicular carbon fiber, acicular fiber glass, acicular carbon nanotubes, and acicular magnesium fiber.

2. The toner particle according to claim 1, wherein the acicular surface additive has a shape selected from the group consisting of a rice shape, a stick shape, a butterfly shape, and a bow tie shape.

3. The toner particle according to claim 1, wherein the acicular surface additive has a length from about 0.25 to about 8 microns.

4. The toner particle according to claim 1, wherein the acicular surface additive has a length from about 0.5 to about 5 microns.

* * * * *